United States Patent [19]

Nozaki et al.

[11] 4,456,392

[45] Jun. 26, 1984

[54] HEAT TRANSFER PRINTER

[75] Inventors: Mineo Nozaki, Kawasaki; Osamu Asakura, Tokyo; Masasumi Nagashima, Yokosuka; Sadao Iwakura, Tokyo, all of Japan

[73] Assignee: Canon Kabushiki Kaisha, Tokyo, Japan

[21] Appl. No.: 319,270

[22] Filed: Nov. 9, 1981

[30] Foreign Application Priority Data

Nov. 14, 1980 [JP] Japan ..... 55-160333

[51] Int. Cl.[3] ..... B41J 3/02; B41J 33/14

[52] U.S. Cl. ..... 400/120; 400/229

[58] Field of Search ..... 400/120, 229, 212, 218, 400/223, 225, 227.1, 227, 235, 235.1, 232, 194, 196, 207, 208, 208.1, 221, 234, 236.2; 346/76 PH

[56] References Cited

U.S. PATENT DOCUMENTS

| | | | |
|---|---|---|---|
| 3,855,448 | 2/1974 | Hawagata et al. | 400/120 X |
| 3,904,018 | 9/1975 | Dewley | 400/229 X |
| 3,985,216 | 10/1976 | McIntosh | 400/120 |
| 4,039,065 | 8/1977 | Seki et al. | 400/120 |
| 4,061,219 | 12/1977 | Nishikawa et al. | 400/229 |

FOREIGN PATENT DOCUMENTS

| | | | |
|---|---|---|---|
| 155847 | 12/1979 | Japan | 400/120 |
| 34934 | 3/1980 | Japan | 400/120 |
| 48004 | 4/1980 | Japan | 400/120 |

OTHER PUBLICATIONS

"Control of Ribbon Speed Relative to Printhead" IBM Tech. Discl. Bulletin, vol. 21, No. 2, Jul. 1978, pp. 448–449.

"Ribbon Drive" Darwin, IBM Tech. Discl. Bulletin, vol. 19, No. 4 (Sep. 1976) pp. 1407–1408.

"Ribbon Feed Mechanism" Breski et al., IBM Tech. Discl. Bulletin, vol. 22, No. 7, Dec. 1979, pp. 2710–2711.

*Primary Examiner*—E. H. Eickholt

*Attorney, Agent, or Firm*—Fitzpatrick, Cella, Harper & Scinto

[57] ABSTRACT

A heat transfer printer prints information while sequentially driving dots of a thermal head to urge them against a platen through a printing paper sheet and a transfer ink ribbon. The printer has a pulse motor or the like which carries the transfer ink ribbon at a speed relative to the stationary printing paper sheet for performing heat transfer printing with the thermal head.

6 Claims, 6 Drawing Figures

HEAT TRANSFER PRINTER

BACKGROUND OF THE INVENTION

1. Field of the Invention

The present invention relates to a heat transfer printer which melts a hot-melt ink of a transfer material by a thermal head and which transfers the ink onto a recording paper sheet for printing.

2. Description of the Prior Art

FIG. 1 shows the construction of a heat transfer printer. A thermal head 4 as a recording head of 7×1 heat-generating dot matrix construction (in the longitudinal and transverse directions, respectively) is urged by a spring 5 against a platen 1 of soft rubber through a printing paper sheet 2 as a recording medium and through a transfer ink ribbon 3 as an ink-bearing member which is prepared by applying to a film a hot-melt ink with a binder. The heat transfer ribbon 3 is fed from a supply reel 3A mounted on a carriage 6 as part of a head displacing mechanism to a take-up reel 3B mounted on the carriage 6, passing between the thermal head 4 and the paper sheet 2.

A spring 9 is mounted between the carriage 6 and one end of a lever 8 which is pivotable about a shaft 7 as a fulcrum on the carriage 6. The spring 9 biases the lever 8 clockwise about the shaft 7. A pulse motor 10 as a power source for transferring the ribbon is mounted to the other end of the lever 8. A ratchet wheel 11 is securely fixed on a motor shaft of this pulse motor 10. The ratchet wheel 11 and the transfer ink ribbon wound around the take-up reel 3B engage each other by the tension exerted by the spring 9 mounted to the end of the lever 8, so that they may be constantly urged against each other independently of the diameter of the coil of the transfer ink ribbon.

The carriage 6 is mounted to stationary shafts 12 and 13 which are parallel to the platen 1, so that the thermal head 4 may be displaced parallel to the platen 1. One end of a tooth belt 14 is fixed to one side of the carriage 6, and the other end of the belt 14 is fixed to the other side of the carriage 6 through pulleys 15 and 16. A gear 17 is formed integrally with the pulley 15 to engage with a gear 19 fixed on the shaft of a pulse motor 18 for the carriage, so that, upon rotation of the pulse motor 18, the tooth belt 14 may be driven to displace the carriage 6 parallel to the platen 1. The construction is such that a speed v of displacement of the carriage 6 is the same as a speed of displacement in the opposite direction of the ink ribbon driven by the pulse motor 10 for the ribbon, and corresponding parts of the transfer ink ribbon 3 and the printing paper sheet 2 are brought into contact with each other when the carriage 6 moves.

An initial switch 20 is turned on and off according to the movement of the carriage 6, for checking the position of the thermal head 4.

The heat transfer printer of the construction as described above is conventionally operated according to the timings of the chart shown in FIG. 2. When the carriage 6 is at the left end under the waiting condition, the initial switch 20 is kept on. When the same pulse is applied to the pulse motor 18 for the carriage and the pulse motor 10 for the ribbon as shown in FIG. 2, the carriage 6 is displaced to the right to turn off the initial switch 20, so that printing may be initiated beginning with the timing of the next pulse.

Since the thermal head 4 on the carriage 6 moves to the right at the speed v, and the transfer ink ribbon 3 is carried at the speed v over the carriage 6 in the opposite direction, the printing paper sheet 2 and the transfer ink ribbon 3 do not move relative to each other and are kept stationary at the part against which the thermal head 4 is urged. At the timing of a pulse t1 which is applied after the pulse at which the initial switch 20 is turned off, dots C2 and C7 of dots C1 to C7 of the thermal head 4 arranged in the column direction are energized for a predetermined period of time by a known technique to melt the hot-melt ink of the transfer ink ribbon 3 and to transfer the molten ink onto the printing paper sheet as dots of predetermined size of the first column of a character as shown in FIG. 3. At the timing of a next pulse t2, dots C1, C6 and C7 are heated for printing the next column of the character. In this manner, the thermal head 4 is displaced parallel to the platen 1 while the respective dots of the thermal head 4 are heated for each column of the character to print the desired character through the transfer ink ribbon 3.

However, with this method, the speed v of the carriage 6 becomes $v \pm \Delta v18$ in practice due to speed fluctuations of the motor which are, in turn, caused by load fluctuations. Meanwhile, the speed $-v$ of the transfer ink ribbon 3 has small fluctuations and may also be represented as $-v \pm \Delta v10$ in practice due to errors in manufacture of the parts involved, the degree of engagement of the pawl of the ratchet wheel 11 with the tape, or the like. Therefore, the transfer ink ribbon 3 and the printing paper sheet 2 have a relative speed, although very small, which may be given by:

$$(v \pm \Delta v18) + (v \pm \Delta v10) = \pm \Delta v18 \pm \Delta v10$$

In the heat transfer printer, the thermal head is, in general, urged against the platen with the transfer ink ribbon and the printing paper sheet interposed therebetween. Upon application of heat, the hot-melt ink in the transfer ink ribbon is transferred to the printing paper sheet. However, all the ink corresponding to the heated dots may not be transferred, and some may be left on the transfer ink ribbon between the printing paper sheet and the transfer ink ribbon having a speed relative to each other.

If there is a small error between the speed of the transfer ink ribbon and that of the printing paper sheet at timings of pulses t1 and t4 shown in FIG. 2, the hot-melt ink which is to be transferred from the transfer ink ribbon 3 to the printing paper sheet 2 is not completely transferred due to oscillations, but is partly returned to the transfer ink ribbon 3. This results in unclear printing as shown in FIG. 3.

At the timings of pulses t2, t3 and t5, the relative speed of the transfer ink ribbon and the printing paper sheet is zero. Therefore, the printing paper sheet and the transfer ink ribbon stick to each other. Then, when the transfer ink ribbon 3 is separated from the printing paper sheet to be taken up on the take-up reel 3B, the ink is transferred to the side of the printing paper sheet due to the difference in adhesiveness between the transfer ink ribbon 3 and the printing paper sheet. Accordingly, the dots are printed at a high density. In this manner, the printing is performed with irregular density with the conventional heat transfer printer.

SUMMARY OF THE INVENTION

It is an object of the present invention to provide an improved heat transfer printer which eliminates the drawbacks of the conventional printers of this type.

It is another object of the present invention to solve the problem of unclear printing due to slight speed fluctuations in displacement of the thermal head, the carrying of the transfer ink ribbon or the like, and to allow consistent, clear printing.

It is another object of the present invention to allow printing at low cost with a transfer ink ribbon which is shorter than the length of the information to be printed, and has a longer service life.

It is still another object of the present invention to solve the problem of the printing paper sheet and the transfer ink ribbon sticking together, and to simplify control of a unit for driving the thermal head.

It is still another object of the present invention to provide a great relative speed between the transfer ink ribbon and the printing paper sheet so as to reduce to the minimum the adverse affects of the slight relative speed between the transfer ink ribbon and the printing paper sheet which might otherwise cause irregular printing density, and to attain clear printing with uniform printing density, so that the service life of the ink ribbon may be prolonged, the cost of recording may be reduced, and the problem of sticking may be solved.

DESCRIPTION OF THE PREFERRED EMBODIMENTS

Figure 1:
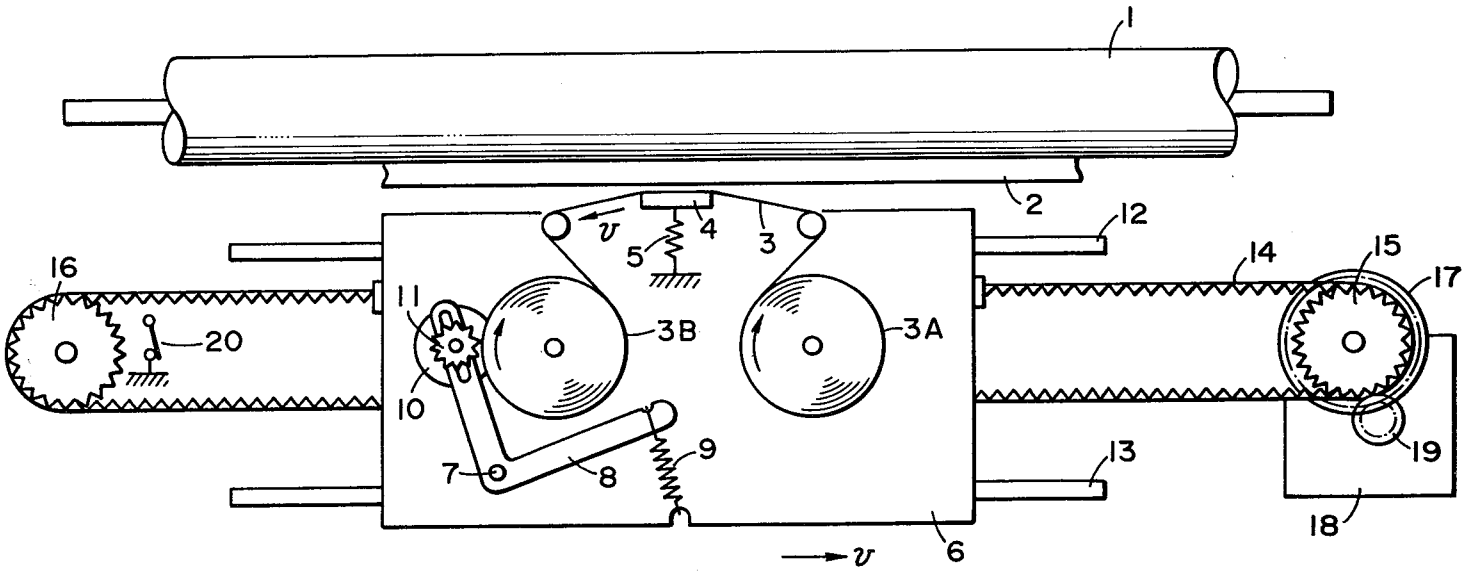
FIG. 1 is a view showing a mechanism of a printer for explaining the embodiment of the present invention.
Figure 2:
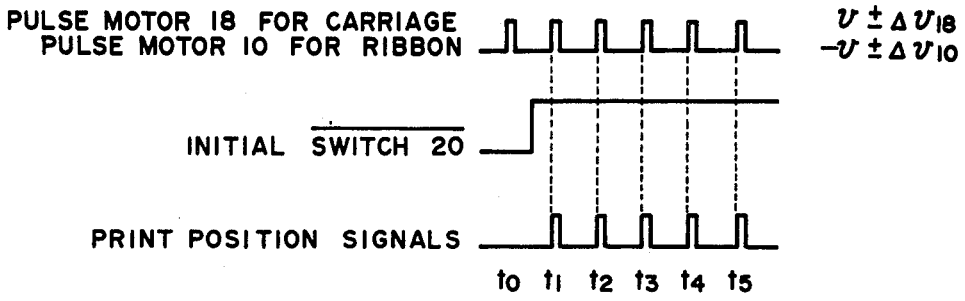
FIG. 2 is a view for explaining printing timings with a conventional printer.
Figure 3:
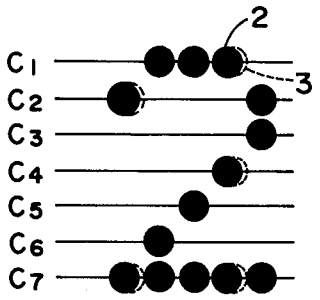
FIG. 3 is a view showing the printing paper sheet and the transfer ink ribbon.
Figure 4:
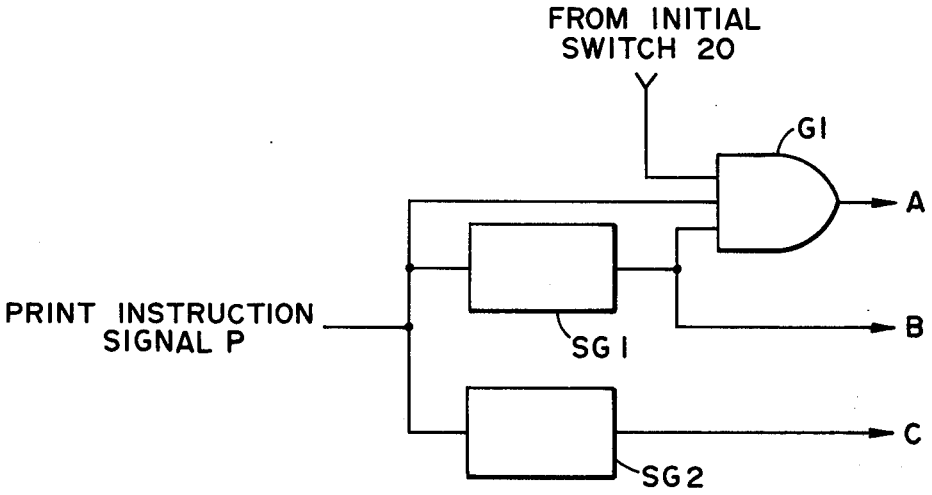
FIG. 4 is a block diagram for explaining control of the operation of a heat transfer printer according to the present invention.

FIG. 4 is a block diagram showing one embodiment of a heat transfer printer of the present invention, the description of which will be made with reference to the mechanism of the heat transfer printer shown in FIG. 1.

Figure 5:
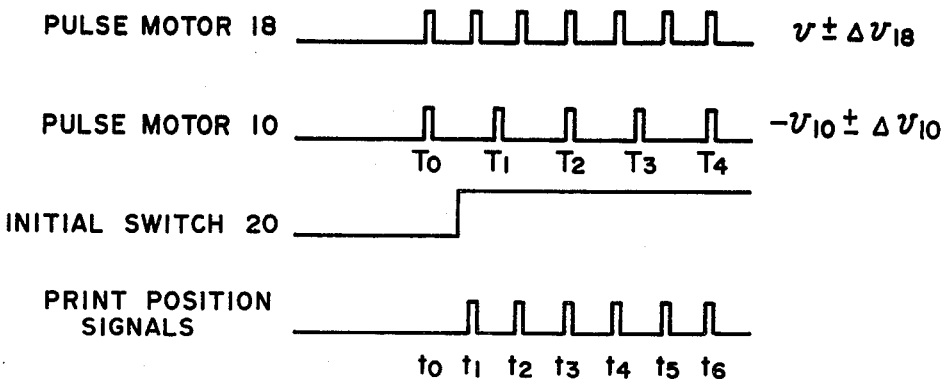
FIG. 5 is a view showing the waveforms of the timing pulses.

Referring to FIG. 4, a signal generator SG1 generates a signal B as shown in FIG. 5 for controlling the drive timings of the pulse motor 18 for the carriage. Another signal generator SG2 generates a signal C for controlling the drive timings of the pulse motor 10 for the ribbon, which signal, as shown in FIG. 5, is different from that generated by the signal generator SG1, that is, a nonsynchronous signal. When the initial switch 20 is turned on, an AND gate G1 gates the signal B generated by the signal generator SG1 to provide a print position signal A.

Pulses of the signal B generated by the signal generator SG1 are applied to a drive circuit (not shown) of the pulse motor 18 for the carriage at timings t0, t1, t2 and so on to control the drive operation of the pulse motor 18 for the carriage.

Pulses of the signal C generated by the signal generator SG2 are applied to a drive circuit (not shown) of the pulse motor 10 for the ribbon at timings T0, T1, T2 and so on to control the drive operation of the pulse motor 10 for ribbon. The signal A from the gate G1 is applied to a drive circuit (not shown) of the thermal head 4 for controlling the print position.

Under the waiting condition wherein the carriage 6 is located at the extreme left end, the carriage 6 turns on the initial switch 20 to close the AND gate G1. When a print instruction signal P is applied, the signal generators SG1 and SG2 are energized to generate the signals as shown in FIG. 5. When a pulse generated by the signal generator SG1 is applied to the pulse motor 18 for the carriage, the rotation of the pulse motor 18 displaces the carriage 6 at the speed v on the shafts 12 and 13 to the right and parallel to the platen 1 through the gears 19 and 17, the pulley 15 and the belt 14.

When the carriage 6 is displaced to turn off the initial switch 20, the AND gate G1 is opened so that printing may be initiated upon the application of the next pulse at timing t1. Conventionally, the ratchet wheel 11 which is in contact with the ribbon wound on the take-up reel 3B on the carriage 6 is constructed to move at the speed v to the left when pulses are applied to the pulse motor 10 for the ribbon as a drive source at the timings corresponding to t0, t1, t2 and so on. Unlike the conventional case, in the embodiment of the present invention, when the pulses are applied to the pulse motor 10 for the ribbon at the timings T0, T1, T2 and so on whose separation is greater than in the case of the timings t0, t1, t2 and so on, the transfer ink ribbon 3 is carried to the left at a speed v10 which is smaller than the speed v. The take-up reel 3B is driven by the ratchet wheel 11 to take up the ink ribbon. In this manner, a relative speed $(v-v10)$ is maintained between the transfer ink ribbon 3 on the carriage 6 and the printing paper sheet 2 which is motionless.

The speed fluctuation will now be considered which is the cause of the irregular printing density in the conventional printer of this type. If the displacing speed of the carriage 6 is represented by $v \pm \Delta v18$ and the carrying speed of the transfer ink ribbon 3 is represented by $v10 \pm \Delta v10$, the relative speed between the transfer ink ribbon 3 and the printing paper sheet 2 may be given by:

$$(v-v10)+(\pm\Delta v18 \pm \Delta v10) \quad \ldots (1)$$

The closer the speed v10 is to the speed v, the more irregular will be the printing density. The closer the speed v10 is to zero, the worse will be the rubbing between the transfer ink ribbon 3 and the printing paper sheet 2 due to the urging force of the thermal head 4 and the worse will be the smearing by the ink of the transfer ink ribbon 3.

According to the experiments conducted, good results are obtained when the speed v10 is within the range of 30 to 90% of the speed v. When the speed v10 takes such a value, the first term representing the relative speed in relation (1) may be represented by $v \times (0.7$ to $0.1)$. On the other hand, the term introduced by the speed fluctuation $\pm v18 \pm \Delta v10$ is negligible as compared with $v \times (0.7$ to $0.1)$. Therefore, according to this method, the relative speed between the transfer ink ribbon 3 and the printing paper sheet 2 may be represented by $(v-v10)$, and the speed fluctuation component $\pm v18 \pm \Delta v10$ does not affect the density of printing.

The thermal head 4 on the carriage 6 is displaced to the right at the speed v, and the transfer ink ribbon 3 on the carriage 6 is also carried at the speed v10 in the opposite direction, so that the transfer ink ribbon 3 and the printing paper sheet 2 are sliding at a relative speed of $(v-v10)$ at the parts where the thermal head 4 is contiguous with the ribbon 3; there is no oscillation in the direction of movement of the ribbon. As in the case of the conventional heat transfer printer, when the next pulse is applied at the timing t1 after the initial switch 20 is turned off, the dots C2 and C7 among the dots C1 to C7 of the thermal head 4 are energized to melt the hot-melt ink at the corresponding parts of the transfer ink ribbon 3 for transfer onto the printing paper sheet 2. However, with the embodiment of the present invention, during the energization of the dots, the transfer ink ribbon 3 moves relative to the thermal head 4 at the speed v10 which is smaller than the conventional speed v; therefore, the length of the transfer ink ribbon required to print the same length of information becomes v10/v of that for the conventional case.

Although the transfer ink ribbon 3 is conventionally required to be the same length as that of the recording length of the printing paper sheet 2, the length of the ribbon consumed may be shortened according to the present invention. The feeding length of the ink ribbon is determined by the pulse separation of the pulses generated by the signal generator, and consumption of the ribbon is decreased when the pulse separation is greater.

Figure 6:
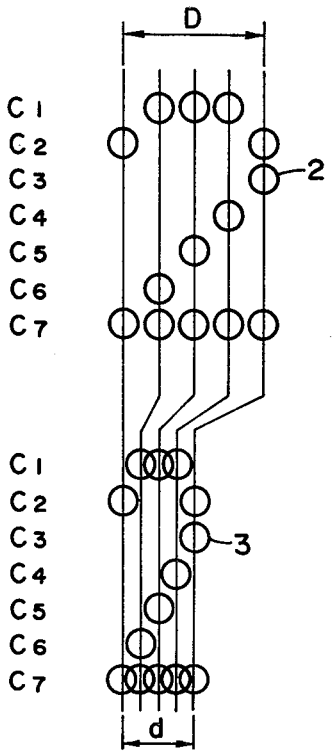
FIG. 6 is a view showing the printing paper sheet and the transfer ink ribbon.

FIG. 6 shows the relationship between the printing paper sheet 2 and the transfer ink ribbon 3. For recording a character of width D, length d of the transfer ink ribbon is required. It is preferable to thicken the coated layer of the ink of the transfer ink ribbon 3. During the energization of the thermal head 4, the transfer ink ribbon 3 is moving at the speed (v−v10) relative to the printing paper sheet 2. Since oscillations due to speed fluctuations between the printing paper sheet 2 and the transfer ink ribbon 3 may be neglected, all the ink of the transfer ink ribbon 3 is transferred to the printing paper sheet 2. The molten ink is "rubbed" on the printing paper sheet 2 as the transfer ink ribbon 3 is urged against the printing paper sheet 2, so that printing may be performed without irregularity in density.

After the timing t1, the dots C1, C6 and C7 are printed at the timing of t2. In a similar manner, the thermal head 4 may be displaced parallel to the platen 1 to sequentially heat the dots of the thermal head 4 to print desired information through the transfer ink ribbon 3. After printing one line, the pulse motor 18 for the carriage is rotated in the reverse direction to displace the carriage 6 to the left until the initial switch 20 is turned on. The printer waits after the switch 20 is on.

The present invention is not limited to the particular embodiment described above. For example, the displacing speed of the thermal head 4 may be controlled by changing the meshing ratio of the gear 19 fixed to the pulse motor 18 for the carriage and the gear 17 formed integrally with the pulley 15. The carrying speed of the transfer ink ribbon 3 may also be controlled by changing the diameter of the ratchet wheel 11. DC or AC motors may be used in place of the pulse motors 10 and 18. In this case, known techniques for determining the torques and rotational frequencies of the motors may be used in place of the signal generators.

In the embodiment described above, the printing paper sheet is fixed in position. However, the printing paper sheet may be displaced as long as a relative speed is maintained between the transfer ink ribbon and the printing paper sheet.

In summary, according to the present invention, the transfer ink ribbon is slid relative to the stationary printing paper sheet while printing is performed by heating and transferring the ink by the thermal head. In this manner, sticking of the molten ink back on the transfer ink ribbon may be prevented, and irregular density printing and unclear printing may be prevented, consistently providing clear printing. The transfer ink ribbon may have a longer service life and the cost of recording information may be decreased. The printing may be made clearer by making the displacing speed of the transfer ink ribbon greater than that of the carriage as may be seen from the fact that the speed fluctuation is negligible. The driving speed of the motor need not be precise, so that control may be easy and reliability may be higher.

What we claim is:

1. A heat transfer printer, comprising:

a thermal head for receiving a drive signal for transferring ink onto a printing paper sheet, which thermal head presses a heat transfer ink ribbon against the printing paper sheet with a predetermined force;

means for continuously and relatively sliding said thermal head and the printing paper sheet so as to cause a first relative speed between said thermal head and said printing paper sheet while said thermal head presses the heat transfer ink ribbon against the printing paper sheet with the predetermined force; and feeding means for feeding the heat transfer ink ribbon by providing a force greater than the friction force caused by the press of said thermal head against the printing paper sheet, to cause a second relative speed between the heat transfer ink ribbon and the printing paper sheet and a third relative speed between the heat transfer ink ribbon and the thermal head which are pressed against each other, said second relative speed and said third relative speed being smaller than said first relative speed.

2. A printer according to claim 1, wherein said feeding means includes, as a drive source, a pulse motor which is driven by a drive signal generated at a timing which is different from a timing of a drive signal applied to said "thermal head".

3. A heat transfer printer, comprising:

a thermal head for receiving a drive signal for transferring ink onto a printing paper sheet, which thermal head presses a heat transfer ink ribbon against the printing paper sheet;

thermal head carrying means for carrying said thermal head along the printing paper sheet; and feeding means for feeding the heat transfer ink ribbon at a predetermined feeding speed that is 30 to 90% of said thermal head carrying speed and in a direction opposite to the carrying direction of said thermal head while said thermal head presses the heat transfer ink ribbon against the printing paper sheet.

4. A heat transfer printer, comprising:

an ink bearing member having a base material with hot-melt ink thereon;

a recording head having a surface with a heat-generating body thereon for recording data on a recording medium in a predetermined direction and for pressing said ink bearing member against a recording medium, said heat-generating body melting the hot-melt ink of said ink bearing member; and means for sliding said ink bearing member relative to the recording medium in said predetermined direction so that the hot-melt ink of said ink bearing member melted by said heat-generating body is pressed against the recording medium to separate completely the melted ink from the base material of said ink bearing member.

5. A heat transfer printer, comprising:

a platen for holding a printing paper sheet on a surface thereof;

a carriage, movable along said platen, for supporting a heat transfer ink ribbon and a thermal head for transferring ink from said heat transfer ink ribbon to the printing paper sheet such that said heat transfer ink ribbon is urged against the printing paper sheet;

means for displacing said carriage at a predetermined speed; and means for feeding the heat transfer ink ribbon at a speed which is different than the predetermined speed of said carriage.

6. A printer according to claim 5, wherein said feeding means feeds the transfer ink ribbon at a speed smaller than the displacing speed of said carriage, in a direction opposite to a displacement of said carriage.

* * * * *

UNITED STATES PATENT AND TRADEMARK OFFICE

CERTIFICATE OF CORRECTION

PATENT NO. : 4,456,392

DATED : June 26, 1984

INVENTOR(S) : MINEO NOZAKI, ET AL.

It is certified that error appears in the above-identified patent and that said Letters Patent is hereby corrected as shown below:

COLUMN 2, line 33, change "(v±Δv10)" to --(-v±Δv10)--.

COLUMN 4, line 37, change "v10±Δv10" to ---v10±Δv10--.

Signed and Sealed this

*Nineteenth* Day of *March 1985*

[SEAL]

*Attest:*

DONALD J. QUIGG

*Attesting Officer*

*Acting Commissioner of Patents and Trademarks*